United States Patent [19]

Morton et al.

[11] 4,197,974

[45] Apr. 15, 1980

[54] NAILER

[75] Inventors: Randolph J. Morton, Deephaven; Lee R. Suchy, Eden Prairie; Glenn F. Wahlquist, White Bear Lake, all of Minn.

[73] Assignee: Speedfast Corporation, Tulsa, Okla.

[21] Appl. No.: 914,596

[22] Filed: Jun. 12, 1978

[51] Int. Cl.[2] ..... B25C 1/04

[52] U.S. Cl. ..... 227/8; 227/120; 227/130

[58] Field of Search ..... 227/8, 120, 130; 173/15

[56] References Cited

U.S. PATENT DOCUMENTS

| | | | |
|---|---|---|---|
| 3,099,837 | 8/1963 | Heilman et al. | 227/130 |
| 3,194,324 | 7/1965 | Langas | 227/8 |
| 3,353,737 | 11/1967 | Howard et al. | 227/130 |
| 3,615,049 | 10/1971 | Obergfell et al. | 227/8 |
| 3,858,781 | 1/1975 | Obergfell et al. | 227/8 |

*Primary Examiner*—John McQuade
*Attorney, Agent, or Firm*—Hugh D. Jaeger

[57] ABSTRACT

A nailer for repeatively driving nails one at a time into material. A safety yoke including an integral safety yoke lever cams against a safety yoke pin in the body of the nailer and actuates a secondary trigger pivotally mounted in a trigger. The secondary trigger actuates a valve plunger in a trigger valve assembly releasing the air over a poppet assembly, causing downward movement of a pneumatic piston assembly carrying a driver blade driving a nail held in a channel guide of a nose into the material. A plurality of tabs on the nose mechanically engage and frictionally lock a nail magazine to the nose. A scroll spring assembly affixes to the nose and biases a pusher in an adjacent track of the magazine towards the nose. A safety yoke detent biased away from the nose moves forwardly into a detent notch in the safety yoke by the pusher when the supply of nails remaining in the magazine reaches a predetermined number.

29 Claims, 15 Drawing Figures

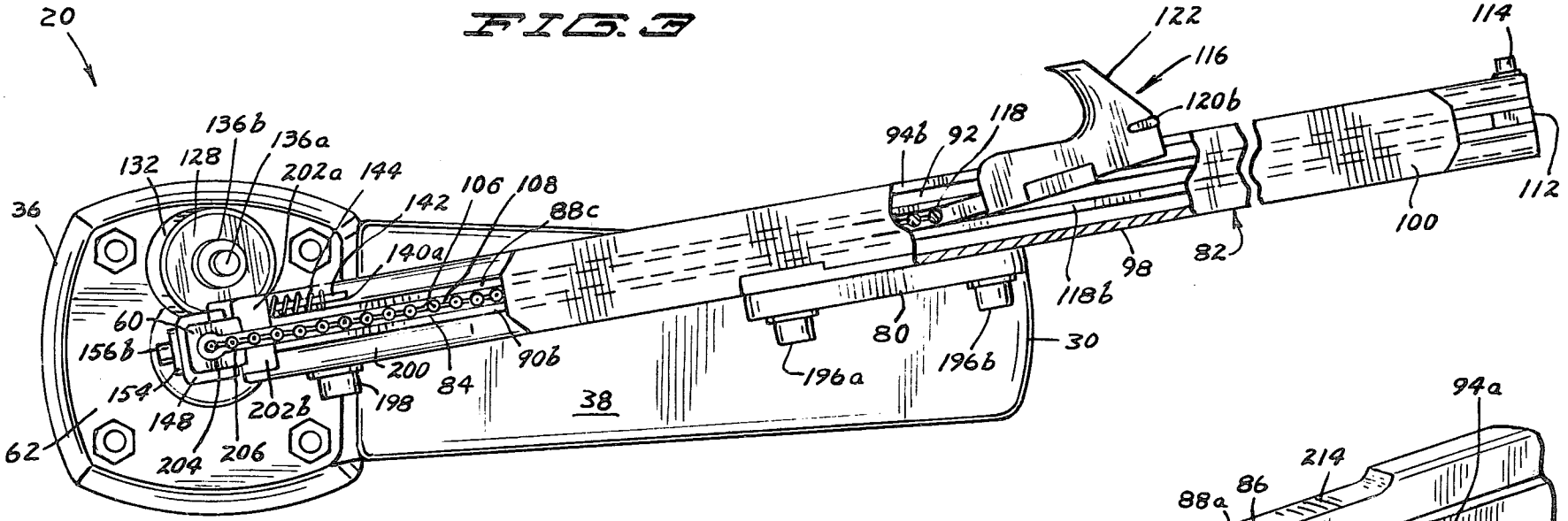
FIG. 3
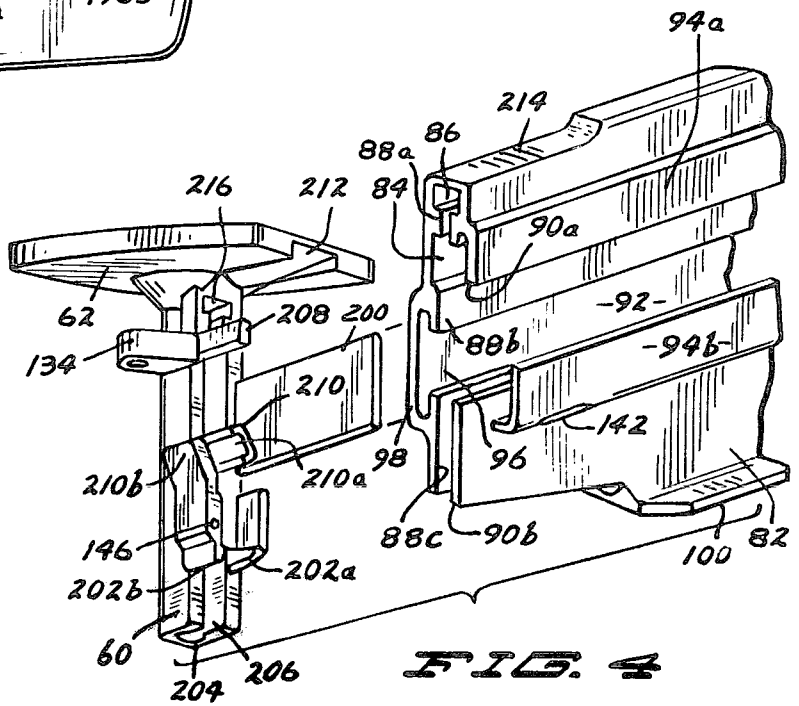
FIG. 4
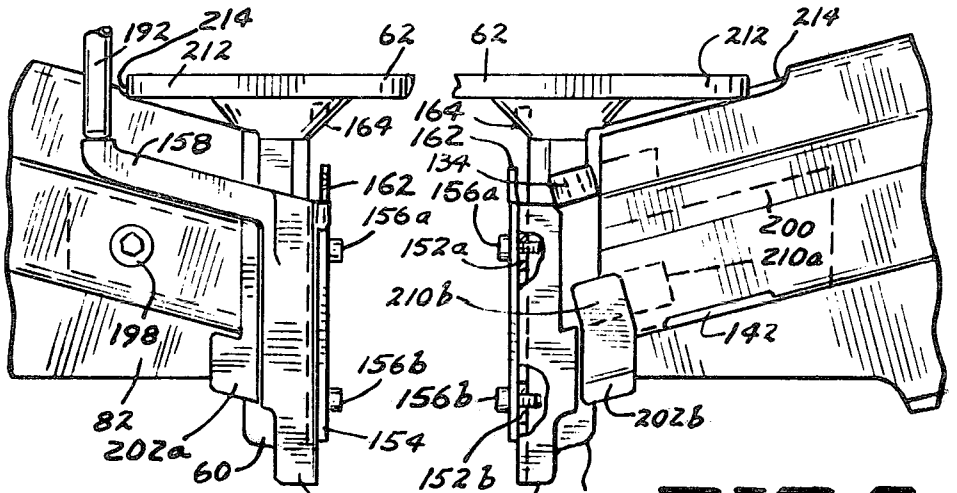
FIG. 5
FIG. 6

36
118a
118b
140
140a
144
210a
210b
162
136c
134
136
165
156b
148
76
74
64
78
66
72
192
194
190
158
216'
220
60
154
218
82
130
132
100
152a
150a
152b
150b
46
20
44
42
62

NAILER

BACKGROUND OF THE INVENTION

1. Field of the Invention

The present invention relates generally to a nailer, and more particularly, pertains to a pneumatic nailer for successively dispensing nails from a magazine and repeatively driving nails.

2. Description of the Prior Art

In the field of nailers, it has been a general practice to employ pneumatic nailers storing a plurality of nails in a magazine which perform a nailing function of repeatively driving one nail at a time into material. Such prior art nailers have been unsatisfactory in that the nailers are physically heavy in weight, large in physical size preventing the nailers from being used in small spaces, and mechanically complex in physical structure resulting in frequent mechanical breakdowns consequently requiring replacement of the mechanical components.

One problem of the prior art nailer is having safety or trigger touch fire assemblies which can be easily defeated resulting in accidental firing of the nailers. It is not uncommon for operators of the prior art nailers who have defeated the safety or trigger mechanisms to accidently fire the nailer driving a nail into a member of the operator's body. It is common for some operators, who have defeated the safety or trigger mechanisms, to drive a nail through an operator's kneecap or other parts of the operator's leg.

Some prior art nailers have noses which cause nails to accumulate and jam in the nose requiring considerable operator time and effort to eliminate the nail jam in the nose. Also, other prior art nailers have nail magazines which are susceptible to nail jams in the magazine further requiring operator time and effort to eliminate the nail jam in the magazine.

Other prior art nailers have complex mechanical lock out systems to prevent the nailers from firing when the nail supply has reached a predetermined number or depletion. Sometimes, the systems fail to function resulting in the firing of the drive mechanism without any nails in the driving position thereby causing damage to the drive system of the nailer.

Most of the prior art nailers have been complex in mechanical structure resulting in frequent breakdowns and requiring frequent maintenance in the event of a mechanical failure of the nailer. The large number of mechanical components results in a higher frequency of mechanical breakdown and incidence of repair. The repair of the prior art nailers usually has to be performed by a highly skilled qualified mechanic capable of working with the complex mechanical assembly of the components of these prior art nailers.

Finally, most of the prior art nailers have a physical structure which results in the pinching of an operator's fingers when firing the trigger; pinching of the operator's fingers when reloading the magazine with nails and actuating the pusher against the nails, and; snagging of the operator's clothing by mechanical components of the nailer, such as the safety system of the nailer, which is dangerous to the operator. The mechanical components of the nailer can snag on articles of clothing such as buttons on shirts and jackets in addition to jewelry such as rings on the operator's hand.

These disadvantages and drawbacks of prior art nailers have been a deterent to use by the construction, industry, and tradespeople.

The present invention obviates the foregoing disadvantages of the prior art by providing a new and novel nailer repeatively driving nails one at a time, each nail being successively dispensed from a plurality of nails stored in a magazine.

SUMMARY OF THE INVENTION

The purpose of the present invention is to provide a pneumatic nailer to repeatively drive nails successively dispensed from a nail magazine, and having a compact physical size, being lightweight, and a mechanical component and structural assemblage permitting heavy-duty usage by construction, industry, and tradespeople.

According to a preferred embodiment of the present invention, there is provided a nailer, for repeatively driving nails one at a time into material, having a body including a piston assembly in a cylinder assembly which supports a driver blade, a first air chamber partially surrounding the cylinder assembly and extending through a handle attached to the body, a poppet assembly disposed above the cylinder assembly and disposed in a third air chamber, a second air chamber which surrounds the lower portion of the cylinder assembly and extending through the handle, a trigger valve assembly in the body connecting the first air chamber to the third air chamber, a trigger assembly mounted on the body to actuate a valve plunger in the trigger valve assembly, a nose secured to the body of the nailer and having a channel to guide a nail driven into the material by the driver blade, a magazine attached to the nose for storing a plurality of nails and sequentially dispensing the nail to the guide channel in the nose, a pusher to bias the nails stored in the magazine towards the nose, and a safety yoke movably mounted on the nose whereby the nose of the nailer is centered at a point of nailing and pressure is exerted by an operator against the body of the nailer to move the safety yoke upwardly on the nose actuating the secondary trigger and permitting the operator to actuate the trigger to thereby drive a nail into the material.

One of the significant aspects and features of the present invention is a nailer having a new and novel safety mechanism preventing accidental firing of the nailer by an operator. To fire the nailer thereby driving a nail into the material, the operator is required to exert pressure against the body of the nailer thereby moving a safety yoke upwardly on the nose camming an integral safety lever which cams against a safety yoke pin thereby moving the safety yoke pin upwardly which actuates a secondary trigger pivotally carried in a trigger. When the operator pulls the trigger, the secondary trigger is in position to actuate a valve plunger in a trigger valve assembly to exhaust air pressure over a poppet assembly causing air to flow into the cylinder assembly resulting in the piston assembly supporting a driver blade to move downward and drive a nail into the material. If the operator fails to exert sufficient pressure to move the safety yoke upwardly on the nose thereby actuating the secondary trigger, the trigger does not fire the nailer. Also, if an operator actuates the trigger while not exerting any pressure on the body of the nailer, the nailer does not fire. One of the utilitarian functions of this nailer is to prevent accidental operation of the nailer.

Another of the significant aspects and features of the present invention is a nailer which accommodates nails of different size and length, and permits easy interchanging from one size nail to another size nail in the nail magazine. Interchanging of nail size is easily accomplished by latching the pusher on a stop at the end of the track, tilting the nailer to have the nails slide to the rear of the nail magazine through the force of gravity, interchanging the nails of one size for the desired size of nails and subsequently unlatching the pusher to automatically set on the end nail thereby biasing the plurality of nails toward the nose of the nailer.

Having briefly described an embodiment of the present invention, it is a principal object hereof to provide a nailer for repeatively driving nails one at a time into the material.

An object of the present invention is to provide a nailer to be utilized in heavy-duty construction work by the construction, industry and tradespeople for repeatively driving nails into material. The nailer in everyday use can be used by construction, industry and tradespeople for assembling wood structures such as houses, wood pallets, etc. or metal to wood structures such as house trailers where the nailer fastens two materials together such as wood to wood, metal to wood, etc. Material is defined as being at least one material, commonly two materials and the term material is not to be construed as being limited in any sense. The nailer is unique in assemblage of the structural components providing a heavy-duty nailer. Also, the nailer is compact in physical structure permitting the nailer to be utilized in small spaces and has a physical weight which does not physically exhaust the operator.

Another object of the present invention is to provide a nailer having a nose which accommodates a uniquely configured magazine which accommodates a wide range of different size nails, the range including six penny to sixteen penny and sizes in between and shank length of two inches to three and one-half inches. The magazine mechanically engages and frictionally locks to the nose of the nailer to successively dispense nails to the nose and can also be mechanically secured between the nose of the nailer and a magazine clamp on the lower handle of the nailer. The base of the magazine is flat permitting upright positioning and storage of the nailer on the base of the magazine when not in use. This new and novel storage feature permits ease of handling of the nailer by an operator.

An additional object of the present invention is to provide a nailer having a safety yoke with an integral safety yoke lever movably mounted on the nose of the nailer to prevent accidental firing of the nailer. To fire the nailer and drive a nail, the operator is required to exert downward pressure on the body of the nailer forcing a spring biased safety yoke to move upwardly on the nose of the nailer. Once sufficient force is exerted on the nose of the nailer towards the material, the safety yoke moves upwardly on the nose to the point that the safety yoke pin is cammed upwardly by the integral safety yoke lever thereby actuating a secondary trigger pivotally mounted in the primary trigger. When the trigger is actuated, the secondary trigger has been actuated in an upward position to actuate the valve plunger in the trigger valve assembly to fire the nailer. In the event that the trigger is actuated without exerting pressure on the body of the nailer, the secondary trigger is not actuated by the safety yoke pin and therefore the nailer does not fire when an operator actuates the trigger. The trigger is pivotally mounted between bosses extending outwardly from the body to eliminate the pinching of an operator's fingers and move importantly, to prevent defeat of the secondary trigger rotatably mounted in the trigger.

A further object of the invention is to provide a nailer having a pusher biased toward the nose of the nailer by a scroll spring which rides in a track of the nail magazine. The pusher rides on and in between pusher rails adjacent to a nail track of the magazine and has an angled vee groove which automatically sets against the end nail in the magazine through the inherent curl in the scroll spring. A handle extends outwardly from the pusher and allows for easy operation of the pusher in the magazine by the operator.

BRIEF DESCRIPTION OF THE DRAWINGS

Other objects and many of the attendant advantages of this invention will be readily appreciated as the same becomes better understood by reference to the following detailed description when considered in connection with the accompanying drawings, in which like reference numerals designate like parts throughout the figures thereof and wherein:

FIG. 1 illustrates a left side view of a preferred embodiment of the invention, a nailer;

FIG. 3 illustrates a bottom view of the nailer;

FIG. 4 illustrates a separated view of a nose and a magazine of the nailer;

FIG. 8 illustrates a partial left side view of the nailer driving a nail;

FIG. 9 illustrates a partial left side view of the nailer, partly cutaway, prior to driving a nail;

DESCRIPTION OF THE PREFERRED EMBODIMENT

Figure 2:
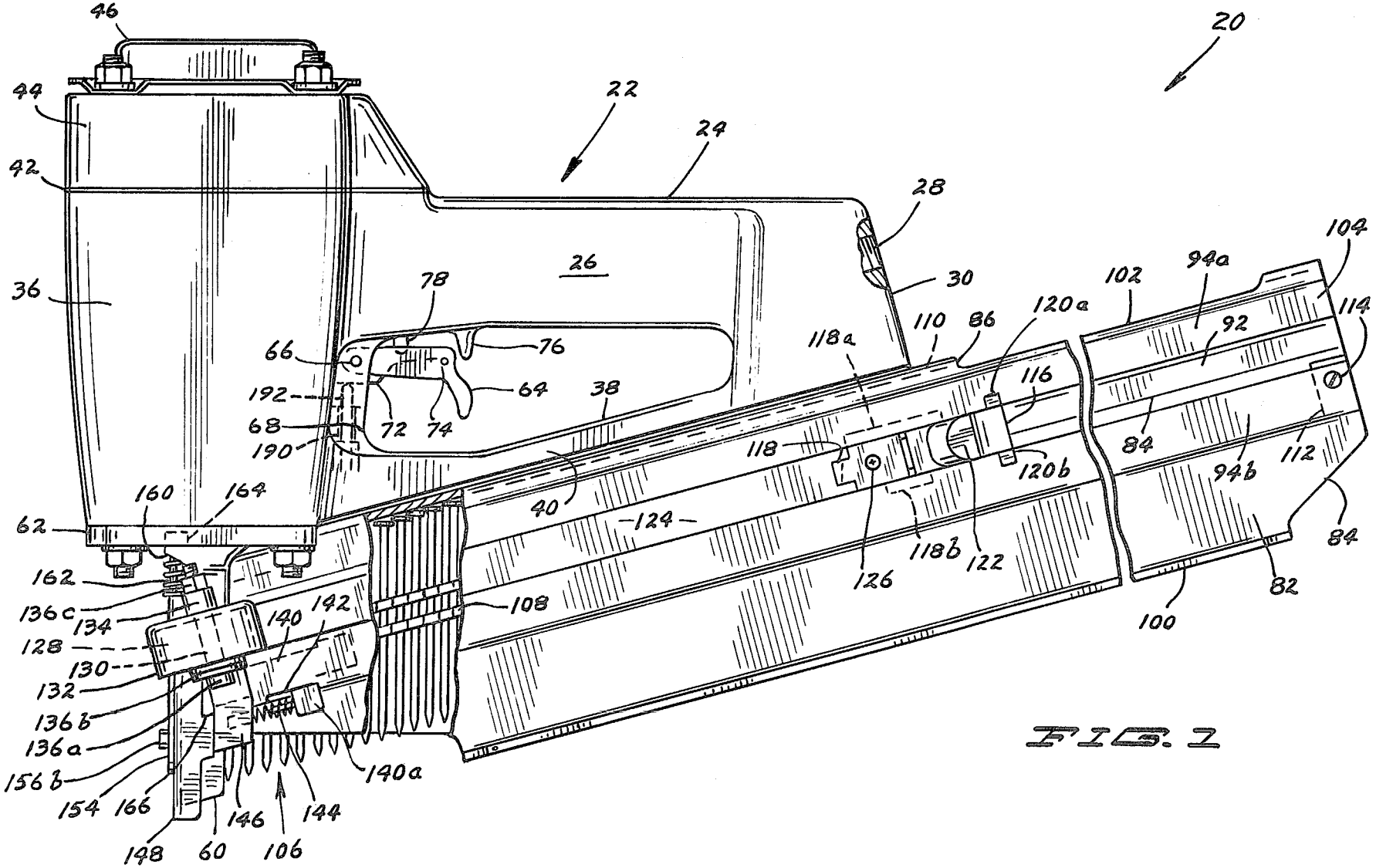
FIG. 2 illustrates an enlarged sectional view of a cylindrical body of the nailer.
Figure 2:
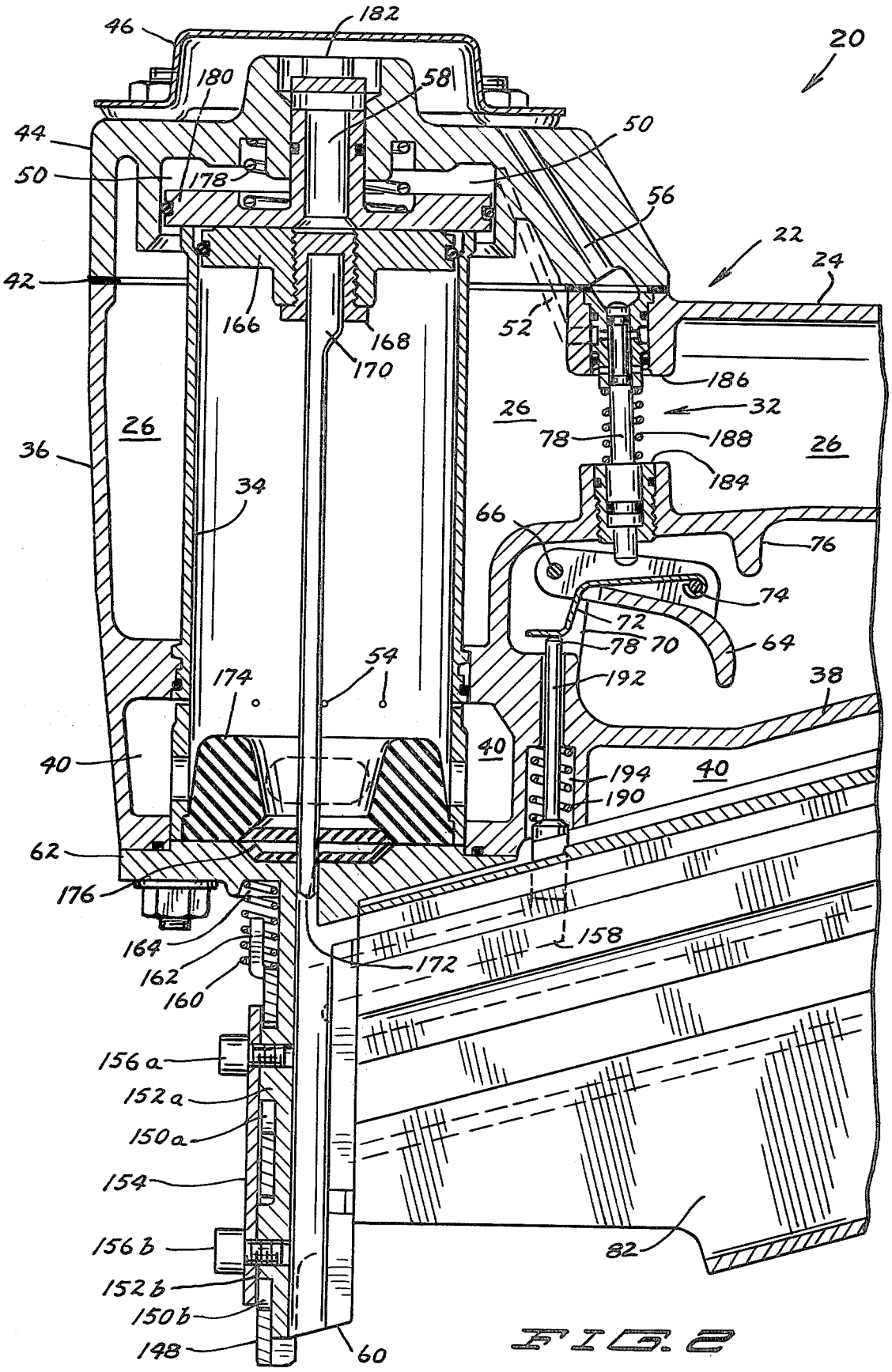

FIG. 1 illustrates a left side view of a preferred embodiment of the invention, a nailer 20. A housing 22 of the nailer 20 is cast and machined from a suitable material, such as lightweight and high strength metal, magnesium by way of example and for purposes of illustration only. Housing 22 includes an upper handle 24 having a first integral internal air chamber 26, extending from an air passage 28 in an end 30 of the housing 22, around a trigger valve assembly 32, as illustrated in FIG. 2, and completely surrounding an upper portion of a cylinder assembly 34, as illustrated in FIG. 2 in a cylindrical body 36 of the housing 22 and a lower handle 38, having a second integral internal air chamber 40 extending from the end 30 of the housing 22 and completely surrounding the lower portion of the cylinder assembly 34 as illustrated in FIG. 2. Four staybolts as illustrated in the figure and not numbered for purposes of clarity in the illustration extend from within the top of the cylindrical body 36 through a gasket 42, a cap 44, and an exhaust deflector 46, and suitable attachments are provided on the end of each staybolt to secure the gasket 42, the cap 44, and the exhaust deflector 46 to the cylindrical body 36. The cap 44 cast from a suitable material, such as magnesium by way of example and for purposes of illustration only, accommodates a third integral internal air chamber 50 as illustrated in FIG. 2. Four staybolts as illustrated in the figure and not numbered for purposes of clarity in the illustration extend from within the bottom of the cylindrical body 36 through a nose 60 having a contiguous base 62, cast from a suitable material such as a high strength material, steel by way of example and purposes of illustration only. Suitable attachments secure the base 62 to the bottom of the cylindrical body 36. A trigger 64 pivotally mounts on a trigger spiral pin 66 affixed between opposing body bosses 68 and 70, illustrated in FIG. 2, and extends outwardly away from the cylindrical body 36. A secondary trigger 72 pivotally mounts on a secondary trigger spiral pin 74 internal to the trigger 64. A trigger boss 76 affixes to the underside of the upper handle 24 behind the trigger 64. A valve plunger 78 extends through the upper handle 24 into the trigger valve assembly 32 and is actuated by the secondary trigger 72.

A nail magazine 82 as illustrated in FIGS. 1 and 4 is extruded from a suitable material such as soft metal, aluminum, by way of example and for purposes of illustration, and mechanically engages and frictionally locks to the nose 60. The magazine 82 comprises a longitudinal nail channel 84 having a longitudinal tee slot 86; first nail channel rails 88*a*, 88*b*, and 88*c* and second nail channel rails 90*a* and 90*b* opposing the first nail channel rails 88*a–c* as illustrated in FIG. 4 to support a plurality of nails where each nail includes a head and shank attached to the head of the nail; a longitudinal pusher channel 92 having an upper pusher rail 94*a* and a lower pusher rail 94*b*, a longitudinal support channel 96 having a support channel rail 98; and, a base 100. A loading slot 102 is disposed on the top of the longitudinal tee slot 86 of nail channel 84 towards an outer end 104 of the magazine to permit the insertion of a plurality of nails 106, collated together with a suitable material 108, such as plastic by way of example and for purposes of illustration only. A nail head track 110 extruded from a suitable material, such as stainless steel by way of example and for purposes of illustration, is disposed in the tee slot 86 of the longitudinal nail channel 84. A stop 112 affixes in the outer end 104 of the magazine 82 between the second nail rail 90*b* of the nail channel 84 and the lower rail 94*b* of the pusher channel 92 with a screw 114.

A pusher 116 includes an angled front vee shaped groove 118 in the forward end of the pusher 116, an inner pusher channel lower tab 118*b* which rides in the longitudinal pusher channel 92, an outer pusher rail upper tab 120*a* and an outer pusher rail lower tab 120*b* which ride on the outside of the pusher rails 94*a* and 94*b* respectively, and an outwardly extending configured handle 122.

One end of a scroll spring 124 fastens with a screw 126 to the forward end of the pusher 116 and the other end of scroll spring 124 connects to drum 128. The drum 128 containing the wound scroll spring 124 is rotatably mounted on a drum spacer 130 and a scroll spring cover 132 covers the drum 128. The drum 128 and the drum spacer 130 are rotatably mounted on a scroll drum tab 134 by a bolt 136*a*, washer 136*b* and nut 136*c* as illustrated in the figure.

A safety yoke detent 140 as illustrated in dashed lines and as also illustrated in FIGS. 8 and 9 slidably mounts between the nail channel rail 94*b* and the lower pusher rail 90*b* and slides through a lower pusher rail channel tab 210. A safety yoke detent arm 140*a* protrudes through a hole 142 in the lower pusher rail 94*b*. A compression spring 144 slides over the safety yoke detent arm 140*a* and fits into a hole 146 as illustrated in FIG. 4 to bias the safety yoke detent 140 towards the outer end 104 of the magazine 82 as illustrated in the figure.

Figures 5, 6, 7:
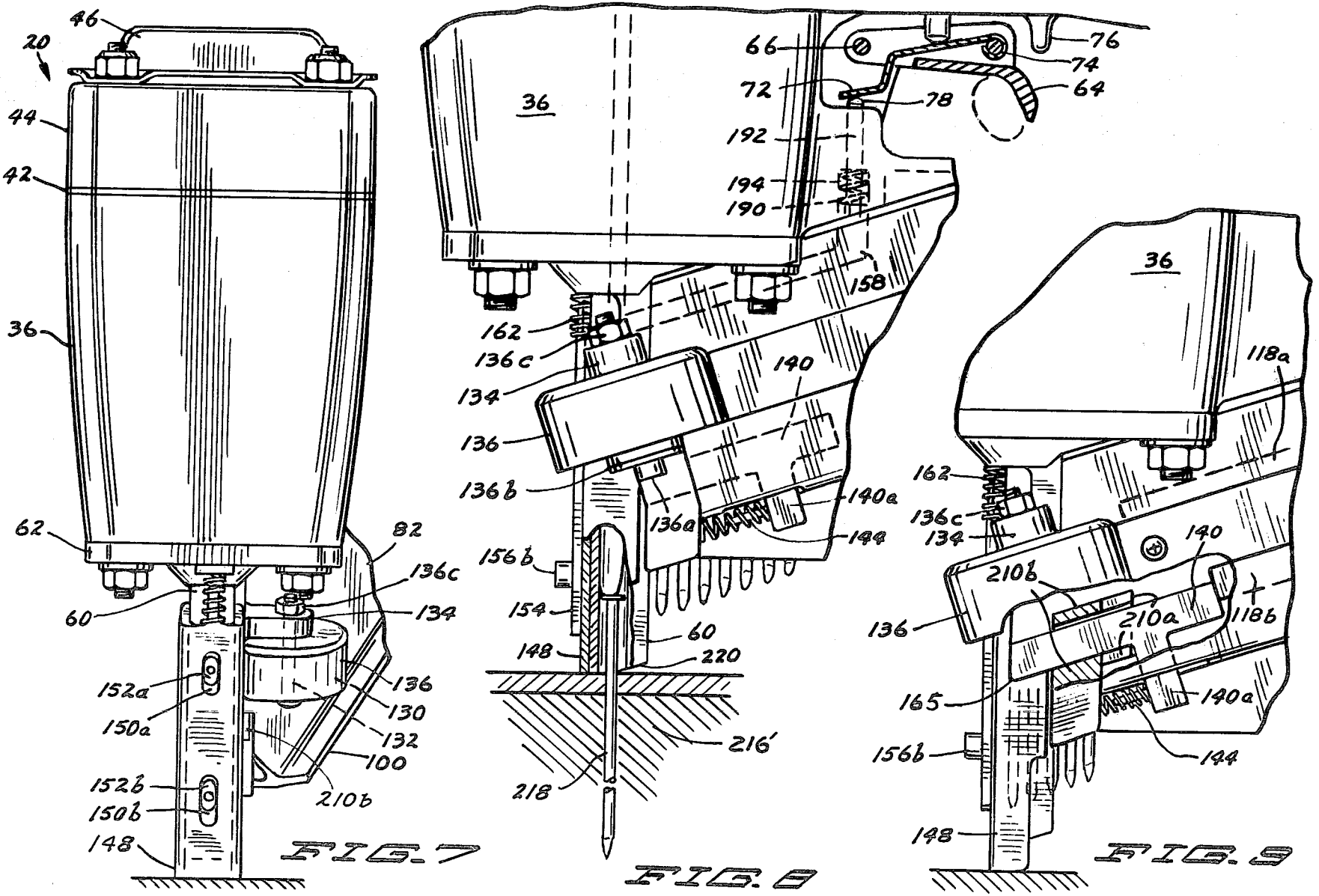
FIG. 5 illustrates a left side enlarged and partially cutaway view of the nose and the magazine of the nailer.
FIG. 6 illustrates a right side enlarged view of the nose and the magazine of the nailer.
FIG. 7 illustrates a front view of the nailer.

A uniquely configured three sided safety yoke 148 having upper and lower elongated holes 150*a* and 150*b* surrounds a front face and two sides of the nose 60 and slidably moves on the nose 60 having upper and lower elongated bosses 152*a* and 152*b* respectively as also illustrated in FIG. 7. A plate 154 secures to the bosses 152*a* and 152*b* with screws 156*a* illustrated in FIG. 2 and 156*b*, and allows upward sliding movement of the safety yoke 148 between the plate 154 and the nose 60. The bosses 152*a* and 152*b* on the nose 60 are of a greater heighth than the thickness of the safety yoke thereby permitting sliding movement of the safety yoke 148 between the plate 154 and the nose 60. A safety yoke lever 158 integral to the safety yoke 148 extends from a right side of the safety yoke 148 as illustrated in FIG. 6. A compression spring 160 fits over a spring retainer 162 protruding upwardly on the safety yoke 148 and is accomodated by a hole 164 in the base 62 of the nose 60. A detent notch 165 in a left side of the safety yoke 148 accommodates the front portion of the safety yoke detent 140 as also illustrated in FIG. 9.

FIG. 2 illustrates an enlarged sectional view of the cylindrical body 36 of the nailer 20 showing the housing 22, the first integral internal air chamber 26, the upper handle 24, the trigger valve assembly 32, the cylinder assembly 34, the lower handle 38, the second integral internal air chamber 40, the gasket 42, the cap 44, the exhaust deflector 46, the third integral internal air chamber 50, the nose 60, the base of the nose 62, the trigger 64, the trigger spiral pin 66, the opposing boss 70, the secondary trigger 72, the secondary trigger spiral pin 74, the trigger boss 76, the valve plunger 78, the magazine 82, the safety yoke 148 having the two elongated holes 150*a* and 150*b*, the two elongated bosses 152*a* and 152*b* on the nose 60, the plate 154, the screws 156*a* and 156*b*, the integral safety yoke lever 158 extending from the safety yoke 148, the compression spring 160, the spring retainer 162, and the hole 164 in the base 62 of the nose 60.

A piston bushing 168 secures a driver blade 170 having a tapered end 172 to a piston assembly 166. A bumper 174 mounts in the bottom of the cylinder assembly 34. A driver seal 176 mounts between the bumper 174 and the top of the base 62 of the nose 60. A compression spring 178 forces a poppet assembly 180 down onto the top of the cylinder assembly 34. An exhaust seal 182 positions in the top of the cap 44 directly above the poppet assembly 180. The trigger valve assembly 32 includes the valve plunger 78, a lower valve bushing 184 as illustrated, a valve body assembly 186 and a valve plunger compression spring 188. A compression spring 190 biases a safety yoke pin 192 vertically downward in a hole 194 in the cylindrical body 36 against the integral safety yoke lever 158 of the safety yoke 148.

FIG. 3 illustrates a bottom view of the invention, the nailer 20, showing the end 30, the cylindrical body 36, the lower handle 38, the nose 60, the base 62 of the nose 60, the magazine 82, the longitudinal nail channnel 84, the first longitudinal nail channel rail 88*c*, the second longitudinal nail channel rail 90*b*, the longitudinal pusher channel 92, the longitudinal lower pusher rail 94*b*, the longitudinal support channel rail 98, the base 100, the plurality of nails 106 connected by the material 108, the stop 112, the screw 114, the pusher 116, the front angled vee notched groove 118, the inner pusher channel lower tab 118*b* which rides on the inside of the pusher rail 94*b*, the outer pusher rail lower tab 120*b* which rides on the outside of the pusher rail 94*b*, the handle 122, the drum 128, the bolt 136*a* and the washer 136*b*, the scroll spring cover 132, the safety yoke detent arm 140*a* protruding through the hole 142, the compression spring 144, the safety yoke 148 surrounding the three sides of the nose 60, the plate 154, and the screw 156*b*.

Screws 196*a* and 196*b* secure a clamp plate 80 extending from the lower handle 38 to the magazine 82 to provide further support for the magazine 82. Screw 198 secures the support channel rail 98 to a support channel tab 200 extending outwardly from the nose 60 as illustrated further in FIGS. 4–6. Opposing support channels 202*a* and 202*b* mechanically engage and support the lower opposing nail rails 88*c* and 90*b*. A channel guide 204 in the nose 60 accommodates a first nail and a nail slot 206 between the channel guide 204 in the nose 60 and an inner end of the magazine 82 accommodates a nail dispensed from the magazine 82. The nose 60 is geometrically angled with respect to the base 62 so that the magazine 82 is mounted at an angle to the lower handle 38 of the nailer of aesthetic as well as functional balance of the nailer 20.

FIG. 4 illustrates a separated view of the cast and machined nose and the extruded magazine 82. The support channel tab 200 extending outwardly from the nose 60 mechanically engages and frictionally locks with the longitudinal support channel 96 of the magazine 82. An upper nail pusher channel tab 208 mechanically engages and frictionally locks between the upper second nail channel rail 90*a* and the upper pusher rail 94*a*. A lower rail pusher channel tab 210 mechanically engages and frictionally locks between the lower second nail channel rail 90*b* and the lower pusher rail 94*b*. A groove 210*a* and hole 210*b* in the lower rail pusher channel tab 210 accommodates the safety yoke detent 140. The opposing first and second lower nail rails 88*c* and 90*b* of the magazine 82 mechanically engage and are supported by the opposing first and second support channels 202*a* and 202*b*. A groove 212 in the base 62 of the nose 60 accommodates the magazine indentation 214 of the magazine 88.

The hole 142 in the magazine 82 accommodates the safety yoke detent arm 140*a*. The hole 146 in the side of the lower pusher rail channel tab 210 accommodates one end of the compression spring 144, the other end of the compression spring 144 slid over the safety yoke detent arm 140*a*. The scroll drum tab 134 supports the drum 128, the drum spacer 130 not illustrated in the FIG. 4, and the scroll cover 132. A tee slot 216 in the nose 62 accommodates the heads of the nails.

FIG. 5 illustrates a left side enlarged and partially cutaway view of the cast and machined nose 60 mechanically engaged and frictionally locked with the magazine 82 having the support channel tab 200 engaged in the longitudinal support channel 96, the upper rail pusher tab 208 and the lower rail pusher tab 210 mechanically engaged in between the nail channel rails 90*a* and 90*b* and the outer pusher rails 94*a* and 94*b* respectively. The opposing support channels 202*a* and 202*b* support the opposing lower nail channel rails 88*c* and 90*b*. The scroll drum tab 134 extends outwardly from the nose 60 to support the scroll spring drum assembly. The elongated bosses 152*a* and 152*b* extend outwardly from the nose 60 and accommodate the elongated holes 150*a* and 150*b* of safety yoke 148. Screws 156*a* and 156*b* fasten the plate 154 to the bosses 152*a* and 152*b* and the safety yoke 148 slides in between the plate 154 and the nose 60. The compression spring 160 not illustrated for purposes of clarity of illustration in the figure slides over the spring retainer 162 and fits into the hole 164 to bias the safety yoke 148 downward over the nose 60 whereby the top of the elongated bosses 152*a* and 152*b* of the nose 60 engage against the top of the elongated holes 150*a* and 150*b* of the safety yoke 148. The groove 212 in the base 62 of the nose 60 accommodates the indentation 214 in the magazine.

FIG. 6 illustrates a right side enlarged view of the nose 60 mechanically engaged and frictionally locked with the magazine 82 having the support channel tab 200 engaged in the longitudinal support channel 96 and secured by the screw 198. The opposing support channels 202*a* and 202*b* support the opposing lower nail rails 88*c* and 90*b*. The groove 212 in the base 62 of the nose 60 accommodates the magazine indentation 214 in the base 62. The safety yoke 148 slides upwardly on the nose 60 between the plate 154 and the face of the nose 60 and is biased downwardly by the compression spring 160 not illustrated in the figure for purposes of clarity of illustration positions between the spring retainer 162 and is retained in the hole 164 in the base 62 of the nose 60. The safety yoke pin 192 is biased downward by the compression spring 190 in the hole 194 as illustrated in FIG. 2 and cams against the top of the safety yoke lever 158 extending from the safety yoke 148.

FIG. 7 illustrates a front view of the nailer 20, showing the cylindrical body 36, the gasket 42, the cap 44, the exhaust deflector 46 and the nose 60. Staybolts with suitable attachments secure elements 42–46 to the top of the cylindrical body 36 and the base 62 having the nose 60 to the bottom of the cylindrical body 36. The magazine 82 mechanically engages and frictionally locks to the nose 60. The bolt 136*a*, the washers 136*b* and the nut 136*c* affixes the drum 128 rotatably supported on the drum spacer 130 and covered by the scroll spring cover 132 to the scroll drum tab 134. The safety yoke detent 148 having elongated holes 150*a* and 150*b* mounts over the elongated bosses 152*a* and 152*b* on the nose 60 for vertical upward sliding movement. The plate 154 not illustrated fastens to the elongated protrusions 152*a* and 152*b* on the nose 60 with screws 156*a* and 156*b* respectively. The safety yoke detent hole 210*b* permits sliding of the safety yoke detent 140 through the slot 210*a*, into the hole 210*b*, and into the safety yoke detent notch 166 as also illustrated in FIG. 9.

Operation of a Preferred Embodiment

In commencing operation of the nailer 20 and making reference to the accompanying figures, the nailer 20 is connected to a source of compressed gas such as compressed air through an air hose coupling screwed into the air passage 28 in the end 30 of the nailer 20 as illustrated in FIG. 1. Preferably, the source of gas is a clean, dry supply of air compressed in the range of 100 pounds per square inch by way of example and for purposes of illustration only, although this is not to be construed as limiting in any sense.

When the nailer 20 is connected to a source of compressed air through the air coupling hole 28, air flows into the nailer 20 through the first integral internal air chamber 26, around past the trigger valve assembly 32, surrounds the cylinder assembly 34, and charges the bottom of the poppet assembly 180 with the equalized pressure as illustrated in FIG. 2. At the same time, air flows around the trigger valve assembly 32, flows through an orifice in the trigger valve assembly 32, in the valve driver body assembly 186, and flows through a channel 52 to the third integral internal air chamber 50 thereby charging the top of the poppet assembly 180 with equalized air pressure as illustrated in FIG. 2. This flow of air creates a blanket of air over the top and bottom of the poppet assembly 180 where the air on the top of the poppet assembly 180 forces the poppet assembly 180 against the bottom of the cylinder assembly 34 as the surface area is greater on the top of the poppet assembly 180 than on the bottom of the poppet assembly 180.

Prior to operation of driving nails, the nailer 20 is loaded with a plurality of collated nails 106. An operator grasps the pusher 116 with a forefinger-thumb combination and slides the pusher 116 along the longitudinal pusher rail channel 92 away from the body 36 of the nailer 20, towards the outer end 104 of the magazine 92 and subsequently latching the outer pusher rail lower tab **120*b* of the pusher 116 behind the stop 112**.

A plurality of nails 106, such as twenty-five by way of example and for purposes of illustration only, are collated together with a suitable material 108 such as plastic to form a group of nails and each group is loaded into the magazine 82 through the top loading slot 102 and pushed down the magazine 82 towards the nose 60 by the operator's hand. The heads of the plurality of nails 106 ride in the nail head track 110 disposed the length of the longitudinal tee slot 86 while the shanks of the nails ride between the opposing first nail rail channels **88*a*–88*c* and second nail rail channels 90*a* and 90*b***.

In this example and by way of illustration only, the extruded magazine 82 holds and dispenses nails in size from six penny have a two inch shank to sixteen penny having a three and one-half inch shank and sizes in between. The outside diameter of the heads of the nails is in the range of 0.260 to 0.270 inches and the outside diameter of the shanks of the nails is in the range 0.113 to 0.148 inches. Once a plurality of collated nails 106 such as three groups of twenty-five nails per group are loaded into the magazine 82, the operator unlatches the pusher 116 from the stop 112 and the angled front vee notched groove 118 of the pusher 116 automatically sets against the first nail towards the outer end of the magazine 82 because of the inherent curl in the scroll spring 124. The scroll spring 124 fastened to the pusher 116 by the screw 126 acts against the pusher 116 to bias the first nail towards the nose 60 by the inherent spring action of the scroll spring 124 wound around the drum 128 and thereby biasing all the nails toward the nose 60. Once the magazine 82 of the nailer 20 is loaded with nails, the nailer 20 is ready for operation.

In operation, the operator's hand grasps the upper handle 24 of the nailer 20 with three fingers on one side and the underside of the upper handle 24 behind the trigger boss 76, the palm of the operator's hand positions on the top side of the upper handle 24 and the thumb of the operator's hand wraps around the other side of the upper handle 24. The forefinger of the operator's hand grasps the underside of the trigger 64 as illustrated in FIG. 8. The nailer 20 is then positioned for driving a nail where the nose 60 carrying the safety yoke 148 is centered at the desired point of driving a nail into the material.

Once the operator positions the nailer 20 at the point of nailing with the circular nail guide chamber 204 centrally positioned at the point of nail insertion into the material, the operator with the palm of the operator's hand forces the upper handle 24 of the nailer 20 downwardly towards the material 216' to be nailed thereby forcing the safety yoke 148 to slide upwards on the nose 60 against the force of the compression spring 160 accommodated between the spring retainer 162 and the hole 164 in the base 62 of the nose 60. As the safety yoke 148 slides upwards where the elongated holes **150*a* and 150*b* ride in line over the elongated bosses 152*a* and 152*b*, the integral safety yoke lever 158 likewise is carried upwards camming against the safety yoke pin 192 riding in the hole 194 in the cylindrical body 36 against the force of the compression spring 190. When the safety yoke 148 reaches the top point of upward sliding movement where the bottom of the elongated holes 150*a* and 150*b* abut against the bottom of the elongated bosses 152*a* and 152*b*, the safety yoke lever 158 cams the safety yoke pin 192 up against secondary trigger 72 thereby pivoting the secondary trigger 72 on the secondary spiral pin 74 into the position as illustrated in FIG. 8**.

FIG. 8 illustrates the nailer 20 driving a nail 218 into the material 216'. While the operator applies force in pushing the nailer 20 downwards toward the material 216' and maintaining the safety yoke 148 in the upward position as illustrated in FIG. 7 so that the end 220 of the nose 60 coincides with the lower end of the safety yoke 148, the operator actuates the trigger 64 with the operator's forefinger as illustrated in the FIG. 8 thereby pivoting the trigger 64 about the trigger spiral pin 66 and carrying the secondary trigger 72 actuated by the safety yoke pin 192 so that the secondary trigger 72 actuates the end of the valve plunger 78 to fire the nailer 20 and drive a nail 218 into the material 216.

When the operator pulls the trigger 64, the valve plunger 78 shifts to an upward position which lets the air on the top of the poppet assembly 180 in the third chamber 50 exhaust coming back through the channel 52, out through the valve plunger 78 in the valve body assembly 186, and up through the channel 56 to the exhaust deflector 46. At this point, the poppet assembly 180 rises because of the air pressure underneath and surrounding the cylinder assembly 34 and seals off the longitudinal passage hole 58 through the poppet assembly 180 against the valve seal 182 in the exhaust deflector 46. The air subsequently circulates around the first integral internal chamber area 26 and forces the piston assembly 166 carrying the driver blade 170 downward in the cylinder assembly 34. When the driver blade 170 carried by the piston assembly 166 is traveling downward, air is initially released by the driver seal 176 at the tapered end 172 of the driver blade 170 so that only a predetermined desired pressure builds up in the second integral internal chamber 40. This initial release of air function controls the amount of air buildup in the second chamber 40 so that the operation of the nailer 20 is very precise as to the pressure exerted by the driver blade 170 against the nail 218.

As the piston assembly 166 carrying the driver blade 170 travels on the downward stroke, the lower chamber 40 of the cylindrical body 36 charges with air and acts as an air spring to force the piston assembly 166 upwardly on the return stroke. As the piston assembly 166 carrying the driver blade 170 reaches the downward point of travel in the cylinder assembly 34, the piston assembly 166 reaches a plurality of holes 54 in the wall of the cylinder assembly 34 which stops the lowest point of travel of the piston assembly 166 by equalizing the air pressure in the first and second chambers 26 and 40. The bumper 174 cushions the forward movement of the piston assembly 166 and rebounds the piston assembly 166 upwards on a return stroke.

When the operator releases the trigger 64, the valve plunger 78 is biased down by the valve plunger compression spring 188 and shuts the air exhaust off through the exhaust channel 56, opens up the air intake channel 52 to the poppet assembly 180 and recharges the poppet assembly 180 with air so that the poppet assembly 180 is forced against the top of the cylinder assembly 34. Consequently, the valve seal 182 opens so that the air pressure equalizes. The lower pressure in the first chamber 26 forces the piston assembly 166 carrying the driver blade 170 upwards and the air over the top of the piston assembly 166 exhausts out the top of the valve seal 182 through the longitudinal hole 58 in the poppet assembly 180 thereby completing the driving cycle of one nail into the material 216'.

The operator then repositions the nailer 20 at the next desired point of nailing and repeats the cycle as described above for repeated driving of nails.

FIG. 9 illustrates the safety yoke detent 140 actuated in the safety yoke detent notch 165. When a predetermined number of nails remain in the magazine 82, the safety yoke detent 140 carrying the safety yoke detent arm **140*a* is biased downward by the pusher 116 against the action of the compression spring 144 and slides through the safety yoke detent slot 210*a*, through the safety yoke detent hole 210*b* and into the safety yoke detent notch 165 in the safety yoke 148. When the safety yoke detent 140 engages into the safety yoke detent notch 165, the first nail remains in the circular nail guide chamber 204 of the nose 60, the second of the nails remains in the nail slot 206 of the nose 60, and the last remaining nails of the predetermined number remain in the magazine 82. While five nails is used as a predetermined number by way of example and for purposes of illustration only, this predetermined number is not to be construed as a limiting number in any sense as the predetermined number is for the sake of convenience and is dependent on the physical size of the safety yoke detent 140 and the pusher 116. Any predetermined number of nails, more or less than five in number, can be utilized for actuation of the safety yoke detent 140 into the safety yoke detent groove 165 by the pusher 116**.

When five nails remain in the magazine 82 in this example, the pusher 116 forces the safety yoke detent 140 carrying the attached safety yoke detent arm **140*a* into the safety yoke detent notch 165 of the safety yoke 148 against the force of the compression spring 144. The safety yoke detent 140 is pushed by the pusher 116 and slides in the safety yoke detent groove 210*a*, through the safety yoke detent hole 210*b* and subsequently mates into the safety yoke detent notch 165 of the safety yoke 148. The compression spring 144 on the safety yoke arm 140*a* ia also compressed into the hole 146 in the side channel 202*b* by the action of the pusher 116 against the safety yoke detent 140**.

Consequently, when the operator pushes the nailer 20 downwardly against the material 216' at the next point of nailing with five nails remaining in the magazine 82, the latching of the safety yoke detent 140 in the detent notch 165 of safety yoke 148 prevents the safety yoke 148 from sliding upwardly on the nose 60 and consequently, the safety yoke pin 192 is not cammed against the secondary trigger 72. Hence, if the operator actuates the trigger 64 with the forefinger, the secondary trigger 72 is not biased in an upward position by the safety yoke pin 192 and does not actuate the valve plunger 78 when the trigger 64 is pulled by the operator.

To reload the magazine 82 with nails, the operator pulls the pusher 116 to the outer end 104 of the magazine 82, latches the pusher 116 over the stop 112 and subsequently reloads the plurality of nails 106 through the loading slot 102 of the magazine 82 as previously described in repeating the loading operation process. When the operator pulls the pusher 116 towards the rear of the magazine 82, the compression spring 144 biases the safety yoke detent 140 to the rear of the hole 142 in the magazine 82 into a rest position as illustrated in FIG. 1.

Figure 11:
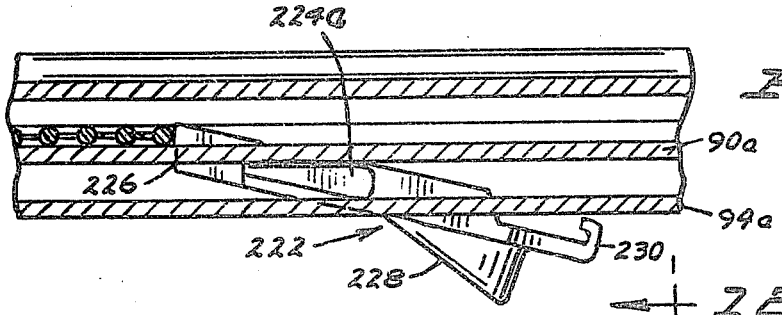
FIG. 11 illustrates a section of the pusher in the magazine on line 11—11 of FIG. 10 looking in the direction of the arrows.
Figure 10:
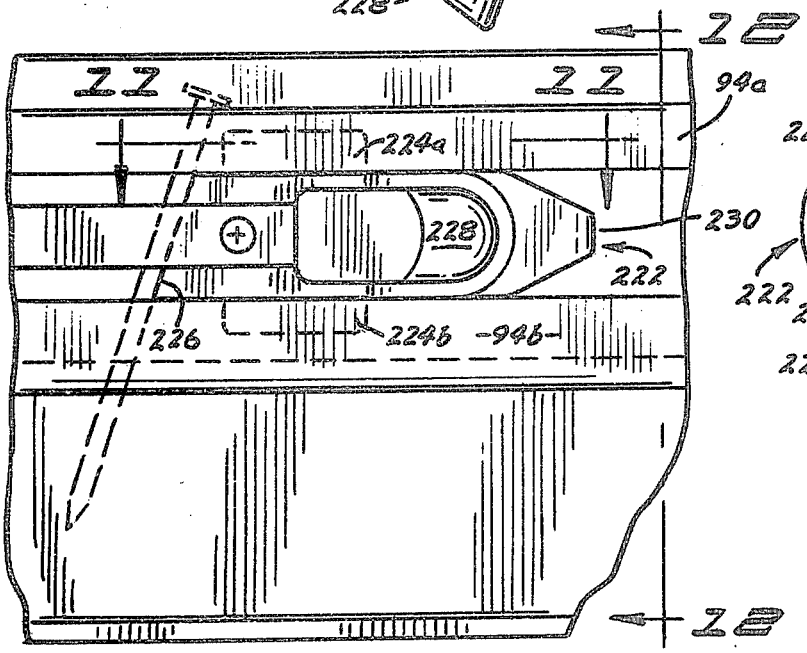
FIG. 10 illustrates another preferred embodiment of a pusher in the magazine.
Figure 12:
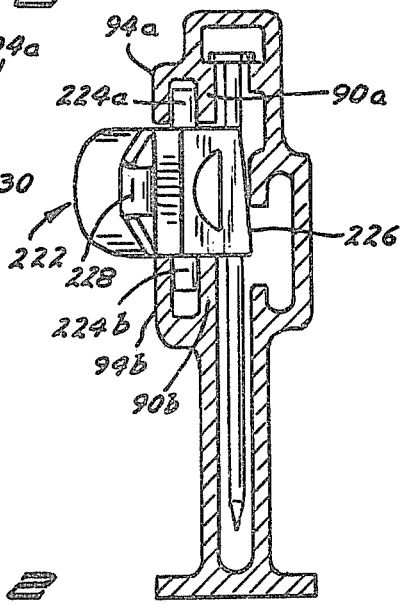
FIG. 12 illustrates a section of the magazine on line 12—12 of FIG. 10 looking in the direction of the arrows.
Figure 13:
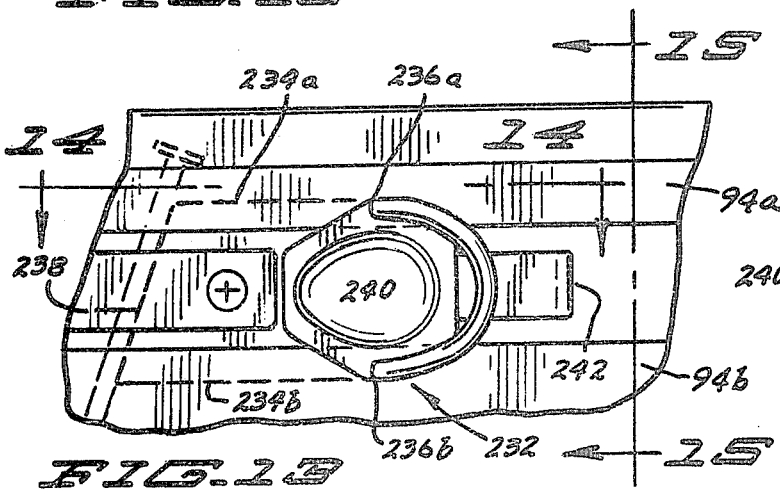
FIG. 13 illustrates a further preferred embodiment of a pusher in the magazine.
Figure 15:
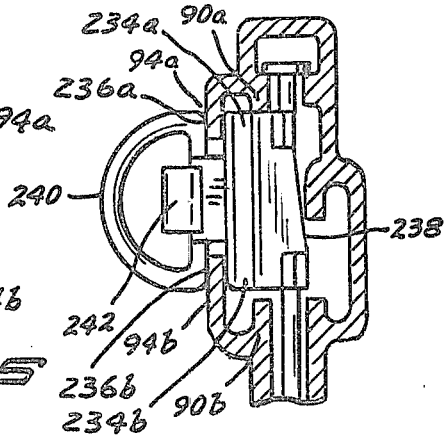
FIG. 15 illustrates a section of the magazine on line 15—15 of FIG. 13 looking in the direction of the arrows.
Figure 14:
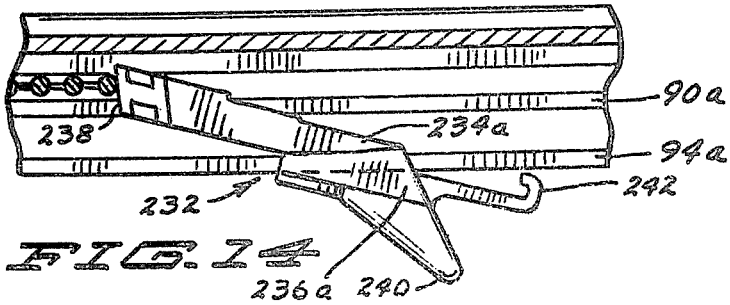
FIG. 14 illustrates a section of the pusher in the magazine on line 14—14 of FIG. 13 looking in the direction of the arrows.

FIGS. 10–12 illustrate another preferred embodiment of a pusher which rides inside of the pusher rails of the extruded magazine 82 while FIGS. 13–15 illustrate a further embodiment of a pusher which straddles both the upper and lower pusher rails of the extruded magazine 82.

FIG. 10 illustrates a partial side view of a pusher 222 having an upper pusher rail tab **224*a* and a lower pusher rail tab 224*b* which ride between the second nail rail channel 90*a* and 90*b* and the upper and lower pusher rails 94*a* and 94*b* respectively of the nail magazine 82; an angled pushing surface 226; a handle 228; and, a latch 230** to hook over the stop.

FIG. 11 illustrates a section view taken on line 11—11 of FIG. 10 showing the pusher 222, the upper pusher rail tab **224*a*, the second nail rail channel 90*a*, the upper pusher rail 94*a*, the angled pushing surface 226, the handle 228 and the latch 230**.

FIG. 12 illustrates a section view taken on line 12—12 of FIG. 10 showing an end view of the pusher 222 having the upper and lower pusher rail tabs **224*a* and 224*b* respectively riding between the second nail rail channel 90*a* and 90*b* and the upper and lower pusher rails 94*a* and 94*b*, the handle 228 and the latch 230. In an additional embodiment, the handle 228 and the latch 230 can be eliminated thereby providing a pusher which rides within the dimensional limits of the pusher track 92 and not having any portion extending beyond the boundary of the pusher rails 94*a* and 94*b***.

FIG. 13 illustrates a partial side view of a pusher 232 having an upper pusher rail inside tab **234*a* and an upper pusher rail outside tab 236*a* which ride over the upper pusher rail 94*a*; a lower pusher rail inside tab 236*b* and a lower pusher rail outside tab 234*b*** which ride over the lower pusher rail 94*b*; an angled pushing surface 238, a handle 240; and, a latch 242 to hook over the stop.

FIG. 14 illustrates a section view taken on line 14—14 of FIG. 13 showing the pusher 232, the pusher rail inside tab 234*a*, the upper pusher rail 94*a*, the pusher rail outside tab 236*a*, the angled pushing surface 238, the handle 240, and the latch 242.

FIG. 15 illustrates a section view taken on line 15—15 of FIG. 13 showing the pusher 232 having upper pusher rail tabs 234*a* and 234*b* and lower pusher rail tabs 236*a* and 236*b* straddling the upper and lower pusher rails 94*a* and 94*b*, the handle 240, and the latch 242.

Various modifications can be made to the nailer of the present invention without departing from the apparent scope of the invention.

The nose 60 can have one large elongated boss in lieu of the two elongated bosses 152*a* and 152*b*. The nose 60 can have at least one extending channel tab in lieu of the three channel tabs as disclosed in the drawings.

The magazine 82 can be extruded to accept common nails, or nails with or without heads, tee nails, staples, etc.

The stop 112 can be constructed and positioned in the outer end 104 of the magazine to accept a plurality of nails through the outer end 104 of the magazine 82 as well as through the top slot 110 of the magazine 82.

The nose 60 can be positioned at any angle with respect to the base 62 to permit desired positioning of the magazine 82 with respect to the cylindrical body 36 of the nailer 20. The specific placement of the magazine 82 with respect to the nose 60 and the clamp plate 80 is not to be construed as limiting in any sense.

A channel safety yoke having five sides can surround the entire nose with the exception of the nail slot 206 and can be utilized in lieu of the safety yoke 148. The channel safety yoke also eliminates the requirement of elongated holes in the safety yoke and elongated bosses on the nose as the channel safety yoke having an integral safety yoke lever is self-supporting in sliding movement on the nose as the integral safety yoke level is confined in lower movement to abutment with the support channel rail and in upper movement to camming against the safety yoke pin 192.

Having thus described the invention, what is claimed and desired to be secured by Letters Patent of the United States is:

1. A nailer supporting a magazine means which dispenses nails successively from a plurality of nails for repeatively driving one nail at a time into material comprising:

a. means supporting a pneumatic system including a cylinder assembly, a piston assembly mounted within said cylinder assembly and having a driver blade attached to said piston assembly in said cylinder assembly, a poppet assembly covering said cylinder assembly, and a means connected between source means of compressed air and said pneumatic system to valve said compressed air to said poppet assembly;

b. trigger means pivotally mounted on said support means to actuate said valve means;

c. nose means connected to said support means to guide a nail driven by said driver blade into said material, said nose means including at least one elongated boss means on said nose means and plate means secured to said boss means;

d. magazine means attached to said nose means to magazine a plurality of nails and successively dispense one nail at a time into said nose means;

e. pusher means to bias said plurality of nails in said magazine means towards said nose means and traveling adjacent to said magazine means, said pusher means including a pusher body having upper and lower pusher rail tabs, a pusher track adjacent said magazine means and spring means mounted between said nose means and said pusher means;

f. safety yoke means including at least one elongated hole means movably slidable on said nose means between said nose means and said plate means and means biasing said safety yoke means away from said support means;

g. means positioned between said safety yoke means and said trigger means to cam said trigger means, thereby permitting said trigger means to actuate said valve means; and, h. safety yoke detent means slidably within said magazine means, means biasing said safety yoke detent means away from a detent notch in said safety yoke means when more than a predetermined number of nails is magazined in said magazine means, whereby when said nose means is positioned at a point of nailing and pressure is exerted against said support means by an operator, said safety yoke means slidably moves upwards on said nose means between said plate means and said nose means to actuate said cam means against said trigger means and when said trigger means is actuated, said trigger means actuates said valve means, passing compressed air through said valve means from said poppet assembly to move said driver blade carried on said piston assembly into said nose means thereby driving said nail into said material, said pusher tabs ride in said pusher track adjacent said magazine means and said spring means biases said pusher means towards said nose means on said pusher track thereby biasing said nails in said magazine means towards said nose means and said pusher means actuates said safety yoke detent means into said detent notch and said safety yoke means when a predetermined number of nails remain in said magazine means and said nose means.

2. The nailer of claim 1 wherein said trigger means comprises a trigger spiral pin rotatably mounted in said support means and a trigger rotatably supported on said trigger spiral pin.

3. The nailer of claim 1 wherein said trigger means comprises a trigger spiral pin rotatably mounted in said support means, a trigger rotatably mounted on said trigger spiral pin, a secondary spiral pin rotatably mounted in said trigger and a secondary trigger rotatably mounted on said secondary spiral pin whereby said secondary trigger is positioned for actuation by said cam means and carried by said trigger to actuate said valve means when said trigger is actuated.

4. The nailer of claim 2 or 3 comprising opposing bosses on said support means surrounding both sides of said trigger mean.

5. The nailer of claim 1 wherein said nose means comprises a longitudinal tee slot to accommodate a nail having a head and shank and a longitudinal circular channel guide to accept said nail having a head and shank from said tee slot whereby said circular channel guide accepts said nail from said tee slot in said nose means and guides said nail during travel of said driver blade down through said circular channel guide thereby driving said nail into said material.

6. The nailer of claim 1 wherein a front face of said nose means is positioned at an angle with respect to a front face of said support means and means connects said magazine means to a rear side face of said nose means.

7. The nailer of claim 1 wherein said nose means comprises a nose, a base fastened to the bottom of said support means and supporting said nose, means extending outwardly from said nose to engage with said magazine means and said elongated boss means supporting said safety yoke means whereby said magazine means mechanically engages and frictionally locks with said extending means and said safety yoke means slides over said elongated boss means.

8. The nailer of claim 7 wherein said extending means comprises at least one longitudinal member extending outwardly from said nose whereby said member mechanically engages and frictionally locks with said magazine means.

9. The nailer of claim 7 wherein said extending means comprises three longitudinal members extending outwardly from said nose, one member extending outwardly on one side of said nose and two additional members extending outwardly on an other side of said nose whereby said members mechanically engage and frictionally lock with said magazine means.

10. The nailer of claim 1 wherein said elongated boss means comprises two elongated boss means on said nose means and said safety yoke means contains two elongated holes having a length longer than said elongated bosses to accommodate said elongated bosses whereby said safety yoke means vertically travels between said plate means and said nose means.

11. The nailer of claim 1 wherein said magazine means comprises a nail track whereby said pusher means biases nails in said nail track towards said nose means.

12. The nailer of claim 1 wherein said magazine means comprises a nail track to accept a plurality of nails wherein each nail includes a head and shank, and a channel to provide longitudinal support for the length of said magazine means whereby said pusher means biases said nails in said nail track towards said nose means.

13. The nailer of claim 1 wherein said magazine means includes a base on the bottom of said magazine means whereby said base provides upright support for said nailer in a rest position.

14. The nailer of claims 11, 12 or 13 wherein a top slot is disposed in an outer end of said magazine means whereby an operator loads a plurality of collated nails through said top slot in said magazine means.

15. The nailer of claim 1 wherein said safety yoke means includes an integral level means extending upwardly on one side of said safety yoke means whereby said lever means acts in conjunction with said camming means to actuate said valve means when said trigger means is actuated to fire said nailer.

16. The nailer of claim 15 wherein said camming means comprises a vertical hole in said support means between said trigger means and adjacent said nose means, a cam pin means supported in said hole, compression spring means biasing said cam pin means toward said nose means whereby said safety yoke lever means integrally carried on said safety yoke means cams said cam pin means against said trigger means to actuate said valve means when said trigger means is actuated thereby firing said nailer and driving a nail into said material.

17. The nailer of claim 1 wherein said pusher rail tab comprise upper and lower inner pusher rail tabs on a forward end of said body and upper and lower outer pusher rail tabs on a rearward end of said pusher body whereby said pusher inner and outer tabs straddle said pusher track adjacent said magazine means.

18. The nailer of claim 17 wherein said pusher means comprises a front angled vee notched groove positioned in the front of said pusher means to accommodate an end nail in said magazine means.

19. The nailer of claim 1 wherein said pusher rail tab comprise opposing inner and outer, upper and lower pusher rail tabs positioned on said pusher body whereby said pusher rail tabs straddle said pusher track.

20. The nailer of claim 17 or 19 wherein said spring means comprises a drum, a scroll spring wound on said drum, a housing rotatably supporting said drum, and means rotatably mounting said scroll spring housing to said nose means.

21. The nailer of claims 17 or 19 wherein said pusher means includes a handle means whereby said handle means is gripped by the operator.

22. The nailer of claim 21 wherein said handle means comprises a hole in said pusher means whereby an operator grips said hole in said pusher.

23. The nailer of claim 21 wherein said handle means comprises an outward extending member on said pusher means whereby an operator grasps said handle.

24. The nailer of claim 1 comprising a nail track adjacent to each other in said magazine means, a safety yoke detent means slidably mounted in between said tracks, compression spring means biasing said safety yoke detent means away from said safety yoke means, whereby said pusher means pushes said safety yoke detent means into said detent notch in said safety yoke means when a predetermined number of nails remains in said magazine means and nose means.

25. The nailer of claims 24 wherein said predetermined number is five nails, two remaining in said nose means and three remaining in said magazine means.

26. The nailer of claim 3 wherein said safety yoke means includes an integral lever means extending upwardly on one side of said safety yoke means and said camming means comprises a vertical hole in said support means between said trigger means and adjacent said nose means, a cam pin means supported in said hole, compression spring means biasing said cam pin means toward said nose means whereby said safety yoke lever means cams said cam pin means against said secondary trigger to thereby actuate said valve means when said trigger means is actuated firing said nailer and driving a nail into said material.

27. The nailer of claim 1 wherein said trigger means comprises a trigger spiral pin rotatably mounted in said support means, a trigger rotatably mounted on said trigger spiral pin, a secondary spiral pin rotatably mounted in said trigger and a secondary trigger rotatably mounted on said secondary spiral pin and wherein said safety yoke means includes an integral lever means extending upwardly on one side of said safety yoke means whereby said lever means acts in conjunction with said camming means to actuate said secondary trigger and carried by said trigger to actuate said valve means when said trigger is actuated to fire said nailer thereby driving a nail into said material.

28. A nailer supporting a magazine means which dispenses nails successively from a plurality of nails for repeatively driving one nail at a time into material comprising:

a. means supporting a pneumatic system including a cylinder assembly, a piston assembly mounted within said cylinder assembly and having a driver blade attached to said piston assembly in said cylinder assembly, a poppet assembly covering said cylinder assembly and a means connected between source means of pressurized air and said pneumatic system to valve said pressurized air to said poppet assembly;

b. trigger means pivotally mounted on said support means to actuate said valve means;

c. nose means connected to said support means to guide a nail driven by said driver blade into said material, said nose means including a nose, a base fastened to the bottom of said support means and supporting said nose;

d. means extending from said nose means to mechanically engage and frictionally lock with said magazine means, said extending means including three longitudinal members extending outwardly from said nose, one member extending outwardly on one side of said nose and two additional opposing members extending outwardly on another side of said nose;

e. magazine means attached to said nose means to magazine a plurality of nails and successively dispense one nail at a time into said nose means, said magazine means including a nail track having opposing upper and lower nail rails, a longitudinal support channel on one side of said track to accept said first extending member and a pusher track having upper and lower sides adjacent on other side of said nail track, said upper and lower nail and pusher tracks accepting said two additional opposing extending members so that said members mechanically engage and frictionally lock with said channel and tracks respectively; and, f. means in said pusher track to push said plurality of nails in said magazine means towards said nose means whereby when said nose means is positioned at a point of nailing, said trigger means is actuated to pass air around said poppet assembly to move said driver blade carried on said piston assembly into said nose means thereby driving said nail into said material.

29. A nailer supporting a magazine means which dispenses nails successively from a plurality of nails for repeatively driving one nail at a time into material comprising:

a. means supporting a pneumatic system including a cylinder assembly, a piston assembly mounted within said cylinder assembly and having a driver blade attached to said piston assembly in said cylinder assembly, a poppet assembly covering said cylinder assembly, and a means connected between source means of compressed air and said pneumatic system to valve said compressed air to said poppet assembly;

b. trigger means pivotally mounted on said support means to actuate said valve means;

c. nose means connected to said support means to guide a nail driven by said driver blade into said material, said nose means including a nose, a base fastened to the bottom of said support means and supporting said nose, three longitudinal members extending outwardly from said nose, one member extending outwardly on one side of said nose and two additional members extending outwardly on another side of said nose;

d. magazine means attached to said nose means to magazine a plurality of nails and successively dispense one nail at a time into said nose means, said magazine means including a nail track having opposing upper and lower nail rails, a longitudinal support channel on one side of said nail track and accepting said one member, and a pusher track having upper and lower rails adjacent another side of said nail track, said opposing upper and lower nail and pusher tracks accepting said two additional members so that said members mechanically engage and frictionally lock in said channel and tracks respectively;

e. pusher means to bias said plurality of nails in said magazine means towards said nose means and traveling adjacent to said magazine means in said pusher track;

f. safety yoke means movably slidable on said nose means and means biasing said safety yoke means away from said support means; and, g. means positioned between said safety yoke means and said trigger means to cam said trigger means whereby when said nose means is positioned at a point of nailing and pressure is exerted against said support means by an operator, said safety yoke means slidably moves upwards on said nose means to actuate said cam means against said trigger means and when said trigger means is actuated, said trigger means actuates said valve means, passing compressed air through said valve means from said poppet assembly to move said driver blade carried on said piston assembly into said nose means thereby driving said nail into said material.

* * * * *